US005836180A

United States Patent [19]

Herman-Latack et al.

[11] Patent Number: 5,836,180

[45] Date of Patent: Nov. 17, 1998

[54] AUTOMATIC WASHER AND DISPENSER CUP THEREFOR

[75] Inventors: Irene M. Herman-Latack, Baroda, Mich.; Nyik Siong Wong; Gregory J. McPherson, both of Singapore, Singapore

[73] Assignee: Whirlpool Corporation, Benton Harbor, Mich.

[21] Appl. No.: 832,994

[22] Filed: Apr. 4, 1997

[30] Foreign Application Priority Data

Nov. 23, 1996 [SG] Singapore ..... 9611409-5

[51] Int. Cl.[6] ..... D06F 39/02

[52] U.S. Cl. ..... 68/17 R

[58] Field of Search ..... 68/17 R; 134/93

[56] References Cited

U.S. PATENT DOCUMENTS

| | | | |
|---|---|---|---|
| 2,712,746 | 7/1955 | Bochan | 68/17 R |
| 2,990,707 | 7/1961 | Gerhardt et al. | 68/17 R X |
| 3,133,673 | 5/1964 | Buss | 68/17 R X |
| 3,144,031 | 8/1964 | Long | 68/17 R X |
| 3,915,349 | 10/1975 | Losert et al. | 68/17 R X |
| 3,921,421 | 11/1975 | Kretchman et al. | 68/17 R |
| 3,975,931 | 8/1976 | Bischkopf | 68/17 R |
| 4,265,100 | 5/1981 | Kretchman et al. | 68/17 R X |
| 4,323,170 | 4/1982 | Ikeda | 68/17 R X |

FOREIGN PATENT DOCUMENTS

| | | | |
|---|---|---|---|
| 112723 | 1/1969 | Denmark | 68/17 R |
| 207200 | 11/1984 | Japan | 68/17 R |
| 60-198195 | 10/1985 | Japan | D06F 39/02 |
| 60-225595 | 11/1985 | Japan | D06F 39/02 |
| 63-257596 | 10/1988 | Japan | D06F 39/02 |
| 4-024099 | 1/1992 | Japan | D06F 39/02 |

*Primary Examiner*—Philip R. Coe

*Attorney, Agent, or Firm*—Thomas A. Schwyn; Robert O. Rice

[57] ABSTRACT

An automatic washer with a removable dispenser cup for dispensing wash additives. The cup is removably mounted for use as a scoop or measuring cup. When mounted, the cup aligns with a water inlet to ensure a complete flushing of the cup to prevent wash additive buildup.

13 Claims, 2 Drawing Sheets

AUTOMATIC WASHER AND DISPENSER CUP THEREFOR

BACKGROUND OF THE INVENTION

1. Field of the Invention

The invention relates to an automatic clothes washer having a wash additive dispenser for dispensing detergent, bleach, softener, and the like, during the wash cycle, and more specifically to a wash additive dispenser having a removably mounted cup, which can be used to scoop the wash additive, and the cup is in line with the water inlet to insure a complete washing of the cup during normal use.

2. Description of the Related Art

It is common in contemporary automatic washers to provide at least one dispenser for dispensing a wash additive, such as detergent, bleach, softener, etc. The dispensers are often automatically actuated during the wash cycle to release the contents of the dispenser into the automatic washer at the appropriate time for the convenience of the user.

Most dispensers comprise a reservoir fixedly mounted to the automatic washer in a location that is accessible by the user for loading the reservoir with the wash additive. Depending upon the size of the reservoir and the location of the dispenser, it can be difficult for a user to pour the wash additive into the reservoir without spilling the wash additive. Additionally, many dispensers do not provide for the reservoir to be flushed with water entering the automatic washer. Over time, residual wash additive that was not flushed from the dispenser reservoir will accumulate, reducing the functionality of the dispenser while becoming aesthetically displeasing to the user.

SUMMARY OF THE INVENTION

The invention addresses these problems by providing an automatic washer having a wash additive dispenser with a removable cup assembly, which can be removed from the dispenser and loaded with a quantity of wash additive. The cup assembly can also be used as a scoop for measuring the wash additive. Additionally, the cup is positioned within the dispenser in such a manner so that it is aligned with the water inlet for the automatic washer, permitting the wash additive to be flushed from the cup assembly during the normal operation of the automatic washer.

According to the invention, the automatic washer comprises a cabinet having a wash treatment zone for receiving a clothes load, which will be cleaned by the automatic washer. A water inlet is provided for introducing water into the wash treatment zone. A wash additive dispenser is provided in the automatic washer and comprises a removable cup assembly, which forms a reservoir for holding a wash additive. The cup assembly is movable between a load position and a use position. When the cup assembly is in the load position, the cup assembly can be removed from the housing assembly and used to measure a quantity of wash additive and returned to the dispenser assembly with the reservoir loaded with the wash additive. When the cup assembly is in the use position, the reservoir is aligned with the water inlet so that during the addition of water the reservoir is flushed out, including the removal of any wash additive held in the reservoir.

Preferably, the cup assembly comprises a cover, with an integral cup, defining the reservoir, movably mounted to a spray skirt disposed below an access opening of the cabinet. The cover is movable between a first and second position.

When the cover is in the first position, the cup is in the load position and when the cover is in the second position, the cup is in the use position. The cover can have a lip forming a handle for moving the cover between the first and second positions. The cup can also have a handle to permit the user to easily grasp the cup to aid in the removal of the cup from the cover.

DESCRIPTION OF THE PREFERRED EMBODIMENT

Figure 1:
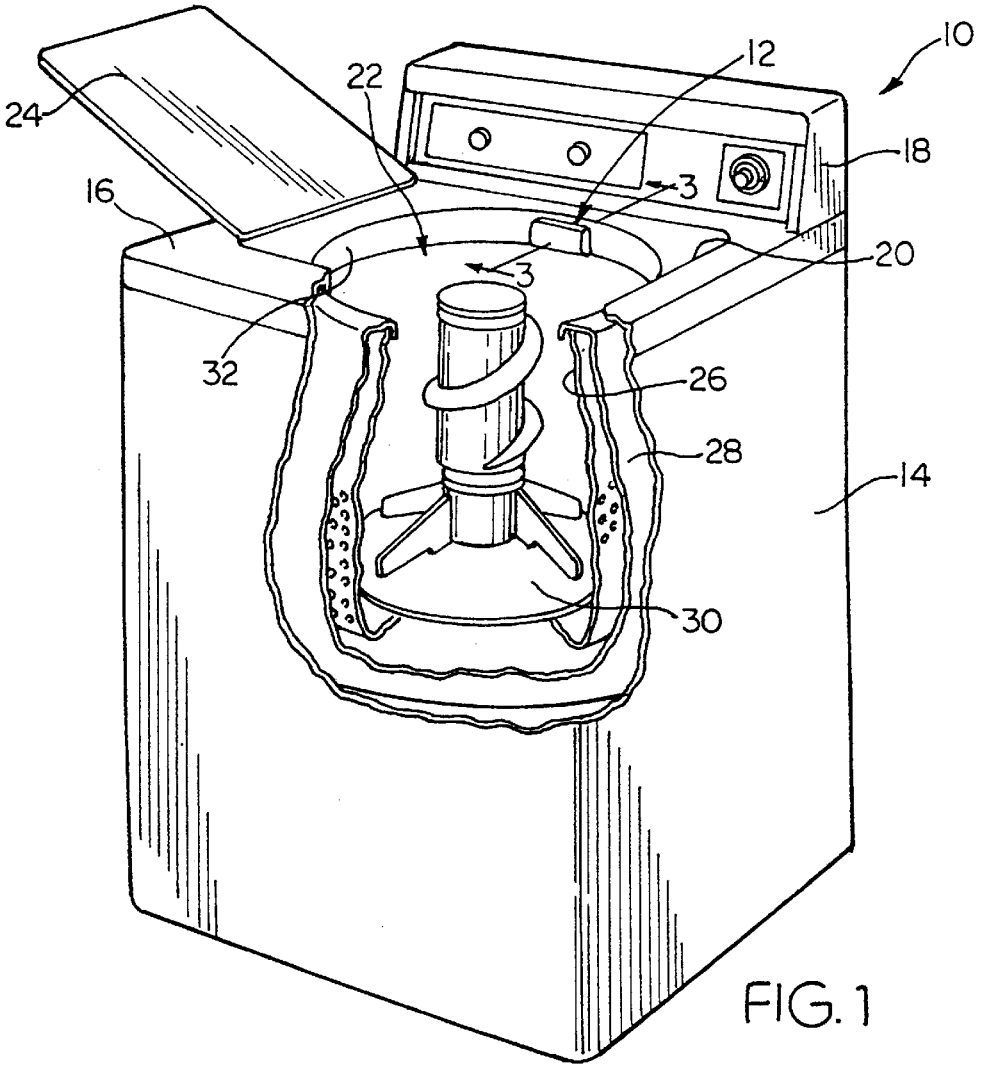
FIG. 1 is a perspective view of an automatic washer having a wash additive dispenser according to the invention.

FIG. 1 illustrates an automatic washer 10 having a wash additive dispenser assembly 12 in accordance with the invention. The automatic washer 10 comprises a cabinet 14 having a top wall 16 on which is provided a control panel 18 for controlling the operation of the automatic washer. The top wall 16 also has an access opening 20, which permits access to a wash zone 22 for washing a clothes load. The access opening 20 is closed by a lid 24 hingedly connected to the top wall 16.

A perforated wash basket 26 partially defines the wash zone 22 and is disposed within the interior of the cabinet 14 and positioned below the access opening 20 so that the clothes load can be positioned into the wash basket 26 through the access opening 20. An imperforate wash tub 28 surrounds the wash basket and retains the wash liquid associated with the automatic washer. A mechanical energy device, such as an impeller or an agitator 30 is provided within the wash basket. The agitator 30 imparts mechanical energy to the clothes load to aid in their cleaning. The wash basket 26 and agitator 30 are connected to a motor whereby the wash basket can be spun and the agitator can be oscillated in a well known manner as part of the wash cycle.

Figure 2:
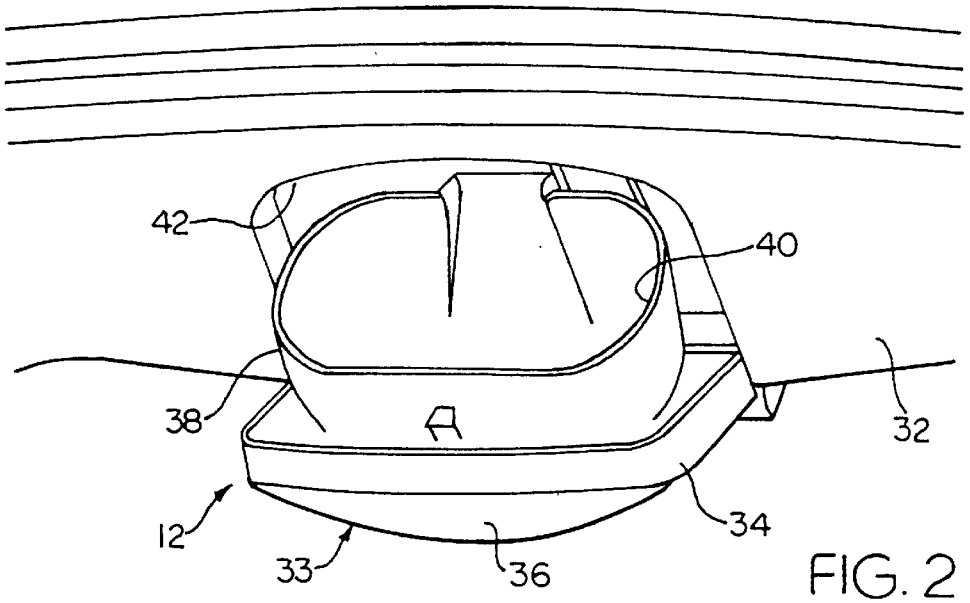
FIG. 2 is a perspective view of the wash additive dispenser in the open or load position, illustrating the relationship between the cover and the cup.

A spray skirt 32 is positioned above the upper edge of the wash basket 26 and wash tub 28 and beneath the top wall 16. The spray skirt 32 retards the movement of clothing and wash liquid over the top of the wash basket and into the wash tub. Referring to FIGS. 1 and 2, the complete wash additive dispenser assembly 12 is preferably mounted to the control housing (underneath the control panel 18) and protrudes through a hole in the top wall of the automatic washer 10 so that it is accessible by the user through the access opening 20. It should be noted that although the wash additive dispenser is illustrated in the environment of a vertical axis washer with an agitator, the invention is not limited to such an environment. The invention can be used in any automatic washer, vertical or horizontal axis regardless of whether the automatic washer has an agitator or impeller or some other mechanical energy device.

Figure 3:
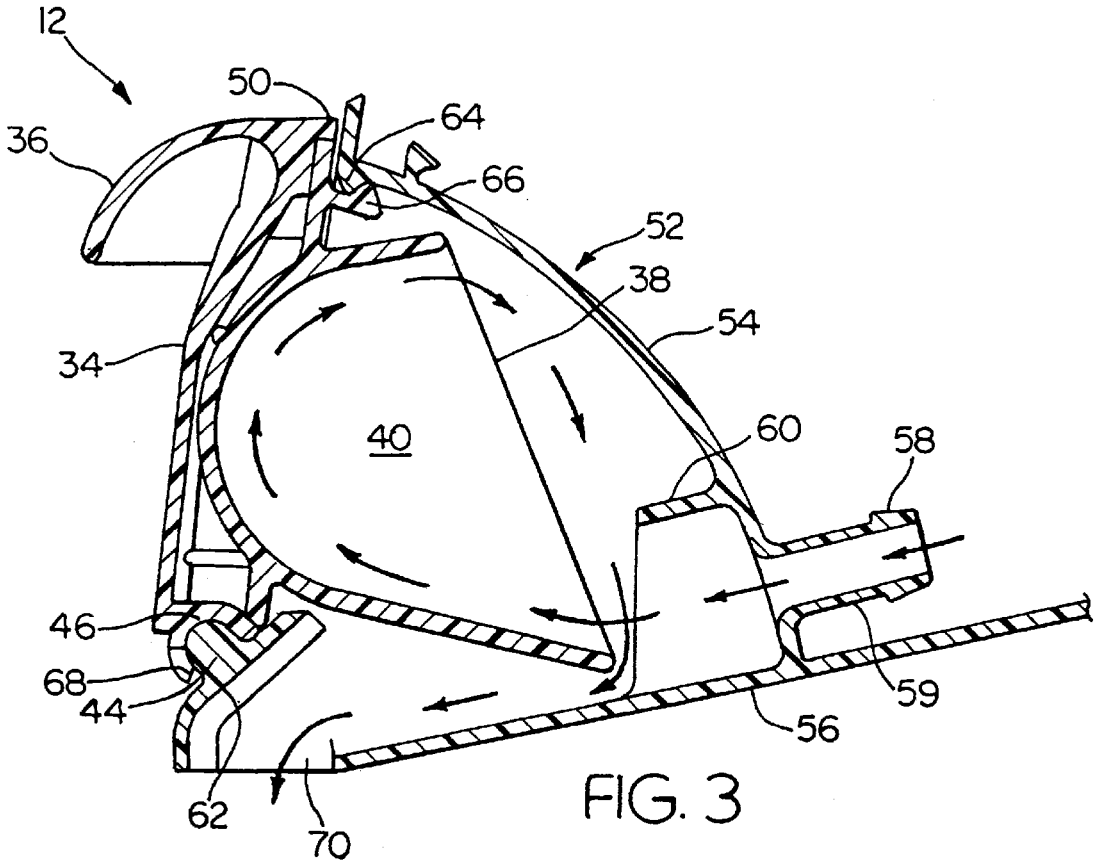
FIG. 3 is a sectional view taken along lines 3—3 of FIG. 1, illustrating the wash additive dispenser in the closed or use position.
Figure 4:
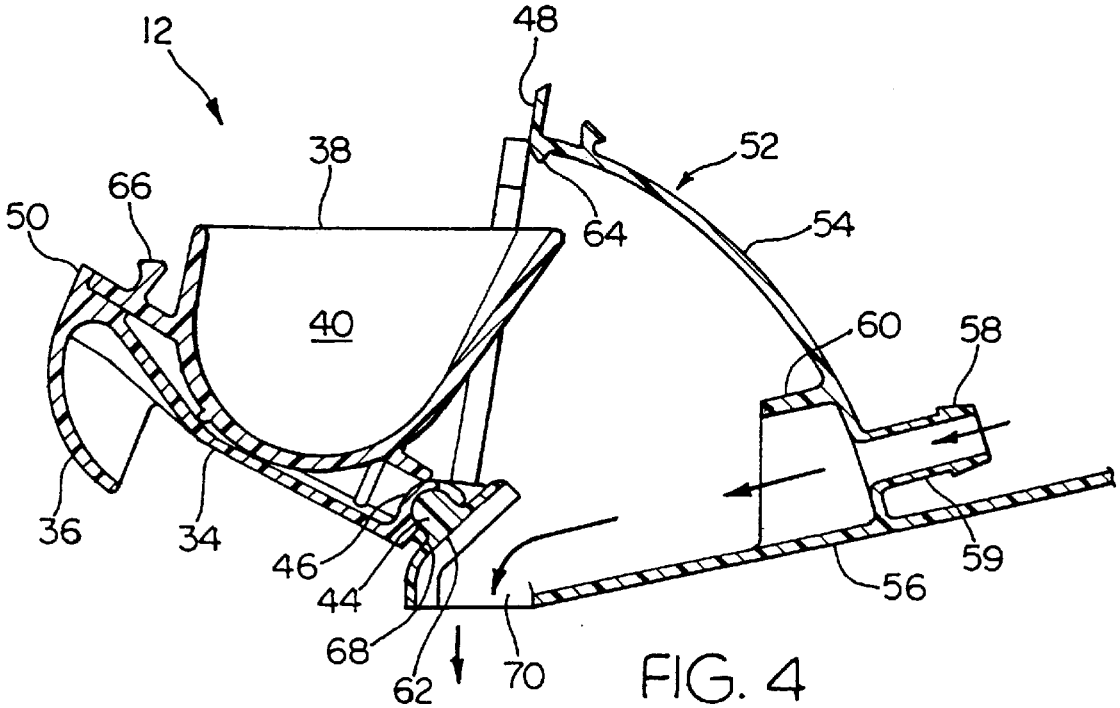
FIG. 4 is a sectional view similar to FIG. 3, except that the wash additive dispenser is shown in the open position.

Referring to FIGS. 2 through 4, the wash additive dispenser assembly 12 comprises a cup assembly 33 having a cover 34, a handle 36 and a cup 38. A cup 38, defines a reservoir 40, and is preferably permanently mounted to the cover 34. The wash additive dispenser assembly 12 further comprises a housing 52 located on the back side of the spray skirt 32 to enclose the cup 38.

The cup assembly 33 is preferably pivotally mounted to the—dispenser housing 52 at a deflector portion 62 thereof. To pivotally mount the cup assembly 33 to the deflector 62, an elongated mounting hinge 44 is formed on the deflector 62 and has a triangular-like cross-section with rounded corners. Fingers 46 are formed on the bottom of the cover 34 and are shaped to sufficiently encircle the mounting hinge 44 to prevent the removal of the cover from the mounting hinge 44 in all position except when the cover is in the open position. The end of the fingers 46 define a series of stops 68 that abut the spray skirt to limit the pivoting of the door.

The housing includes a curved rear wall 54 and a generally planar bottom wall 56. The rear wall 54 includes a water nozzle 58 connected to the water inlet for providing water into the wash zone 22 and the cup 38. The water nozzle 58 includes a water guide 59, which fluidly connects the water inlet to the interior of the housing. The water guide 59 directs the water from the inlet, to the cup 38, if it is installed, and then to the wash zone 22 through an opening 70 defined by the bottom edge of spray skirt 32 and the bottom wall 56 of the housing 52. The spray skirt guide 62 helps in directing the water to the opening 70. Also a protector shield 60 extends from the housing 52 and encircles the outlet of the water guide 59. The housing further has a tab 64, which is adjacent the upper edge of the opening 42 of the spray skirt 32 and which corresponds to a locking tab 66 extending upwardly from the peripheral flange 48 of the housing 52.

It should be noted that although the cup assembly is illustrated in the preferred embodiment as a cover with an integrally mounted cup, it is within the scope of the invention for the cup assembly to comprise other suitable constructions including without limitation: a cover with a removably mounted cup; or only a cup, especially if a portion of the cup functions to cover the opening in the housing.

In operation, the cover 34 of the wash additive dispenser assembly 12 normally begins in the closed position with the locking tab 66 engaging the tab 64 of the housing to secure the cover in the closed or use position. For purposes of this description, it will be assumed that the cup 38 is currently empty of any wash additive. To open the cover 34, the user grasps the handle 36 and rotates the cover 34 about the axis defined by the elongated mounting hinge 44 and the semi-circular snap 46. The cover is opened until a stop 68 abuts the front surface of the spray skirt 32.

Once the stop 68 abuts the spray skirt 32, the cover is in the open position and the cup is in the load position. The cup 38 is shaped such that when it is in the load position, its peripheral edge is substantially horizontal to permit the loading of the cup without undue spillage.

To remove the cup assembly 33 from the housing 52, the user rotates the cup assembly by pulling on the handle of the cover 34 until the cup assembly is free to be removed from the mounting hinge 44. The user can then use the cup as a measuring cup by filling the cup with the desired wash additive, or use the cup as a scoop to fill the reservoir with the wash additive.

The cup assembly 33 with a filled cup 38 is then replaced onto the mounting hinge 44, the user then rotates the cover 34 back to the closed position, until the locking tab 66 engages the tab 64 on the housing 52. In the closed position, the cup is in the use position as illustrated in FIG. 3. The cup is shaped so that one edge of the cup extends into the path of the water directed by the water guide. Also, in the use position, the contents of the cup is immediately dumped into the housing 52 where it can spill into the wash zone through the access opening 70. The wash additive that is not carried by gravity into the wash zone, is flushed from the cup 38 by water entering the housing 52 through the water nozzle 58.

As can be seen in FIG. 3, when the cup is in the use position substantially all of the water is caught by the edge of the cup 38 and is used to flush the contents of the cup from the cup where it subsequently flows into the wash zone 22. By directing the water exiting the water nozzle 58 from the water guide into the cup 38, it is possible to flush all of the wash additive from the cup, preventing wash additive buildup and keeping the cup aesthetically pleasing to the user.

As is seen in FIG. 4, if the cup assembly 33 is left in the open position or the cup assembly 33 is not mounted to the mounting hinge 44, the water exiting the water nozzle 58 will flow directly from the water guide 59 to the deflector 62 and into the wash zone 22. Thus, if desired by a user, it is possible to fill the reservoir 40 of the cup 38 with a wash additive, but not immediately dump the wash additive into the wash zone by closing the cover 34. The user can then come back at the desired time in the wash cycle and close the cover 34 to dump the contents of the reservoir 40 as might be the desired case with the addition of a softener. Also, if the user fails to replace the cup assembly or close the cover, it will not detrimentally impact the performance of the automatic washer because the flow of inlet water will not be altered; unlike some prior art designs where the inlet water would spray against the cover, spraying water beyond the tub and possibly onto the user if the lid 24 is left open.

The invention provides the user of an automatic washer with greater convenience by permitting the user to remove the cup from a wash additive dispenser and fill it externally of the automatic washer and use the cup as a scoop for obtaining a quantity of a wash additive. In addition, the removable cup is flushed by the incoming water used during the wash cycle to insure that the wash additive is thoroughly removed from the cup, preventing wash additive build-up which is aesthetically displeasing to most users.

We claim:

1. An automatic washer comprising:

a cabinet having a wash treatment zone for receiving a clothes load for washing;

a water inlet for providing water to the wash treatment zone; and a wash additive dispenser assembly comprising a cover having a removable cup assembly forming a reservoir for holding a wash additive and being moveable between a load position and a use position, wherein when the cup assembly is in the load position, the cup assembly can be removed from the cover and used as a scoop to measure a quantity of additive and returned to the dispenser assembly loaded with a wash additive, and when the cup assembly is in the use position, the reservoir is aligned with the water inlet so that during the addition of water at least the reservoir portion of the cup assembly is washed by such water.

2. The automatic washer as claimed in claim 1, wherein when the cup assembly is in the load position, the reservoir is not aligned with the water inlet.

3. The automatic washer as claimed in claim 1, wherein the cover is moveable between a first and second position and wherein when the cover is in the first position, the cup is in the load position and when the cover is in the second position, the cup is in the use position.

4. The automatic washer as claimed in claim 3, wherein the cabinet further comprises a wash basket, which at least partially defines the wash zone, an access opening closed by a door to provide access to the wash basket, a spray skirt surrounding such access opening, the wash additive dispenser assembly having a housing mounted on the back side of said spray skirt, and the cover is movably mounted to the housing, wherein when the cover is in the first position, the cup can be accessed through the access opening and when the cover is in the second position the cup is disposed behind the spray skirt and out of view through the access opening.

5. The automatic washer as claimed in claim 4, wherein the housing includes a deflector and the cover is pivotally mounted to the deflector and pivots between the first and second positions.

6. The automatic washer as claimed in claim 4, wherein the housing has a mounting hinge and the cover has a finger adapted to be mounted on the mounting hinge to mount the cover to the housing.

7. The automatic washer as claimed in claim 6, wherein the cover has a lip forming a handle for moving the cover to the first position.

8. The automatic washer as claimed in claim 1, wherein the cup assembly comprises a cup defining the reservoir.

9. The automatic washer as claimed in claim 8, wherein the cup assembly further comprises a cover to which the cup is mounted.

10. An automatic washer comprising:

a cabinet having an access opening closed by an openable door;

an imperforate wash tub mounted within the cabinet for holding wash liquid;

a perforated wash basket provided within the wash tub for receiving a clothes load for washing;

a water inlet provided mounted within the cabinet to permit the introduction of water into the wash tub; and a wash additive dispenser comprising:

a housing with a housing opening;

a cover for closing the housing opening and moveable between a load position and a use position, and a cup forming a reservoir for holding a wash additive and being removably mounted to the housing, wherein when the cover is in the load position, the cup is not aligned with the water inlet and the cup can be removed from the cover and used as a scoop to measure a quantity of additive, and when the cover is in the use position, the cup is aligned with the water inlet so that during the addition of water the cup is washed out including the removal of any wash additive held in the cup.

11. The automatic washer as claimed in claim 10, and further comprising a spray skirt disposed between the access opening and the wash basket, and the cover is movably mounted to the housing, wherein when the cover is in the load position, the cup can be accessed through the access opening and when the cover is in the use position, the cup is disposed behind the spray skirt and out of view through the access opening.

12. The automatic washer as claimed in claim 11, wherein the cover is pivotally mounted to the housing and it pivots between the load and use positions.

13. The automatic washer as claimed in claim 11, wherein the cover has a lip forming a handle for moving the cover to the load position.

* * * * *